US005950447A

United States Patent [19]

Maeda et al.

[11] Patent Number: 5,950,447

[45] Date of Patent: Sep. 14, 1999

[54] DESICCANT ASSISTED AIR CONDITIONING SYSTEM

[75] Inventors: Kensaku Maeda; Tai Furuya; Hiroyasu Nowatari, all of Fujisawa, Japan

[73] Assignee: Ebara Corporation, Tokyo, Japan

[21] Appl. No.: 08/861,009

[22] Filed: May 21, 1997

[30] Foreign Application Priority Data

May 24, 1996 [JP] Japan ..... 8-153410

[51] Int. Cl.[6] ..... F25D 23/00

[52] U.S. Cl. ..... 62/271; 62/94

[58] Field of Search ..... 62/271, 94, 238.3, 62/238.7

[56] References Cited

U.S. PATENT DOCUMENTS

| | | | |
|---|---|---|---|
| 4,430,864 | 2/1984 | Mathiprakasm . | |
| 4,887,438 | 12/1989 | Meckler . | |
| 5,325,676 | 7/1994 | Meckler . | |
| 5,448,895 | 9/1995 | Coellner et al. | 62/94 |
| 5,548,970 | 8/1996 | Cunningham, Jr. et al. | 62/271 |
| 5,718,122 | 2/1998 | Meada | 62/185 |
| 5,749,230 | 5/1998 | Coellner et al. | 62/94 |
| 5,816,065 | 10/1998 | Maeda | 62/271 |
| 5,826,641 | 10/1998 | Bierwirth et al. | 165/48.1 |

OTHER PUBLICATIONS

U.S. application No. 08/781,038, Maeda, filed Jan. 9, 1997, Air Conditioning System.

U.S. application No. 08/780,276, Maeda, filed Jan. 9, 1997, Desiccant Assisted Air Conditioning System.

*Primary Examiner*—Henry Bennett
*Assistant Examiner*—Mark Shulman
*Attorney, Agent, or Firm*—Armstrong, Westman, Hattori, McLeland & Naughton

[57] ABSTRACT

A desiccant assisted air conditioning system, incorporating desiccant members in each of separate passages for process air and regeneration air, is presented to significantly improve the cooling efficiency to utilize the low and high temperature heat sources of a heat pump device. While one desiccant is dehumidifying so that moisture in the process air is being adsorbed in the one passage while the regeneration air is removing moisture from the desiccant in the other passage. The combined effect of this arrangement enables to produce cooling effect in excess of the cooling capacity of the heat pump device, and to achieve a significantly higher energy efficiency for operating the air conditioning system.

6 Claims, 8 Drawing Sheets

DESICCANT ASSISTED AIR CONDITIONING SYSTEM

BACKGROUND OF THE INVENTION

1. Field of the Invention

The present invention relates in general to air conditioners, and relates in particular to an air conditioning system having a continuous air processing capability by alternately treating the process air through at least two units of desiccants.

2. Description of the Related Art

FIG. 7 shows a prior art example of desiccant assisted air conditioning system same as the system disclosed in a U.S. Pat. No. 4,430,864. The system comprises: a process air passage A; a regeneration air passage B; two desiccant beds 103A, 103B; and a heat pump device 200 for desiccant regeneration and cooling of process air. The heat pump device 200 utilizes heat exchangers, embedded in the two desiccant beds 103A and 103B, as high and low temperature heat sources. In each of the thermal medium passages, there are opposingly disposed expansion valves 240A, 240B and one-way valves 241A, 241B, which are arranged parallel to the expansion valves 240A, 240B respectively, and the direction of compression of the compressor 230 can be switched by a four-way valve 250.

In the technology described above, cooling and dehumidifying processes can be explained with reference to a psychrometric chart shown in FIG. 8. The process air (state K) is withdrawn by a blower 102 through a passage 110, raised in pressure, and is forwarded to the one desiccant bed 103A through the passage 111 and the four-way valve 105 and passage 112A, where the moisture in the process air is adsorbed, to lower its humidity ratio and raise its temperature by the effect of the heat of adsorption. Because the desiccant bed 103A is cooled by the heat pump 200 through the heat exchanger 220, the adsorption heat is absorbed and the temperature of the process air does not rise too much, and after satulating (state L), the process air is dehumidified along iso-relative humidity line. The process air which has been dehumidified and maintained at a temperature (state N) is supplied to the conditioning space through the passage 113A, the four-way valve 106, passage 114. An enthalpy difference DQ is thus produced between the return air from the conditioning space (state K) and the cooled process air (state N), to provide cooling of the conditioning space. The regeneration process of the desiccant is performed as follows. Regeneration air (state Q) is withdrawn into the blower 140 through the passage 120, raised in pressure, and is forwarded to the other desiccant bed 103B through the passages 121, 122, the four-way valve 106, and the passage 113B. The desiccant bed 103B is heated by the heat pump 200 by way of the heat exchanger 210, so its temperature is raised, and the relative humidity is lowered (state R). The regeneration air which now has a lowered relative humidity passes through the desiccant bed 103B to remove the moisture from the desiccant material (state T). The regeneration air which has passed through the desiccant bed 103B passes through the passage 112B, four-way valve 105 and the passage 124 and is discharged to an outside environment.

After the air conditioning process has been carried out for sometime and the moisture content in the desiccant becomes higher than a certain value, the four-way valve is operated to be switched, so that the air passages for the desiccants and cooling/heating of the heat pumps are interchanged. Thus, the operation is carried on so that the regenerated desiccant is used to continue air conditioning operation while the other desiccant is being regenerated. Therefore, it can be seen that the processes of adsorption and regeneration are conducted in a batch type system.

In the technology described above, heat exchange of the low temperature heat source of the heat pump and the desiccant for adsorption are embedded into a unit, and heat exchange of the high temperature heat source of the heat pump and the desiccant on the regeneration side are embedded into a unit. So, the cooling effect DQ is provided by a direct thermal load on the heat pump (refrigeration device), which means that it is not possible to generate more cooling than that allowed by the capacity of the heat pump acting as a refrigeration device. Therefore, this configuration does not provide any advantages worthy of making the apparatus complex.

SUMMARY OF THE INVENTION

It is an object of the present invention to provide a high efficiency air conditioning system in which, while operating on a batch system, desiccant regeneration and process air dehumidification can be carried out simultaneously.

The object has been achieved in a desiccant assisted air conditioning system comprising: a process air passage for dehumidification of process air and a regeneration air passage for regeneration of a desiccant material; at least two desiccant members, one desiccant member being disposed in the process air passage and other desiccant member being disposed in the regeneration air passage; a sensible heat exchanger; and a heat pump device, wherein a high temperature heat source of the heat pump device is disposed in the regeneration air passage for heating regeneration air, a low temperature heat source is disposed in the process air passage for cooling of process air, and the sensible heat exchanger exchanges heat between process air which has passed through the one desiccant member and regeneration air which has not yet entered into the other desiccant member. Accordingly, the heat pump device is used as a heat source for conditioning of the desiccant material to achieve higher thermal efficiency as well as using the heated process air to provide increase the temperature of the regeneration air to achieve even higher thermal efficiency.

An aspect of the system is that a sensible heat exchanger is provided for transferring heat between regeneration air which has passed through the other desiccant member and regeneration air which has not yet entered into the high temperature heat source. Accordingly, the heat from the spent regeneration air is used to preheat the regeneration air before it is allowed to go into the high temperature heat source, thereby fully utilizing available heat from the system.

Another aspect of the system is that the heat pump device is a vapor compression heat pump.

Another aspect of the system is that the heat pump device is an absorption heat pump.

DESCRIPTION OF THE PREFERRED EMBODIMENTS

In the following, preferred embodiments will be presented with reference to the attached drawings.

Figure 1:
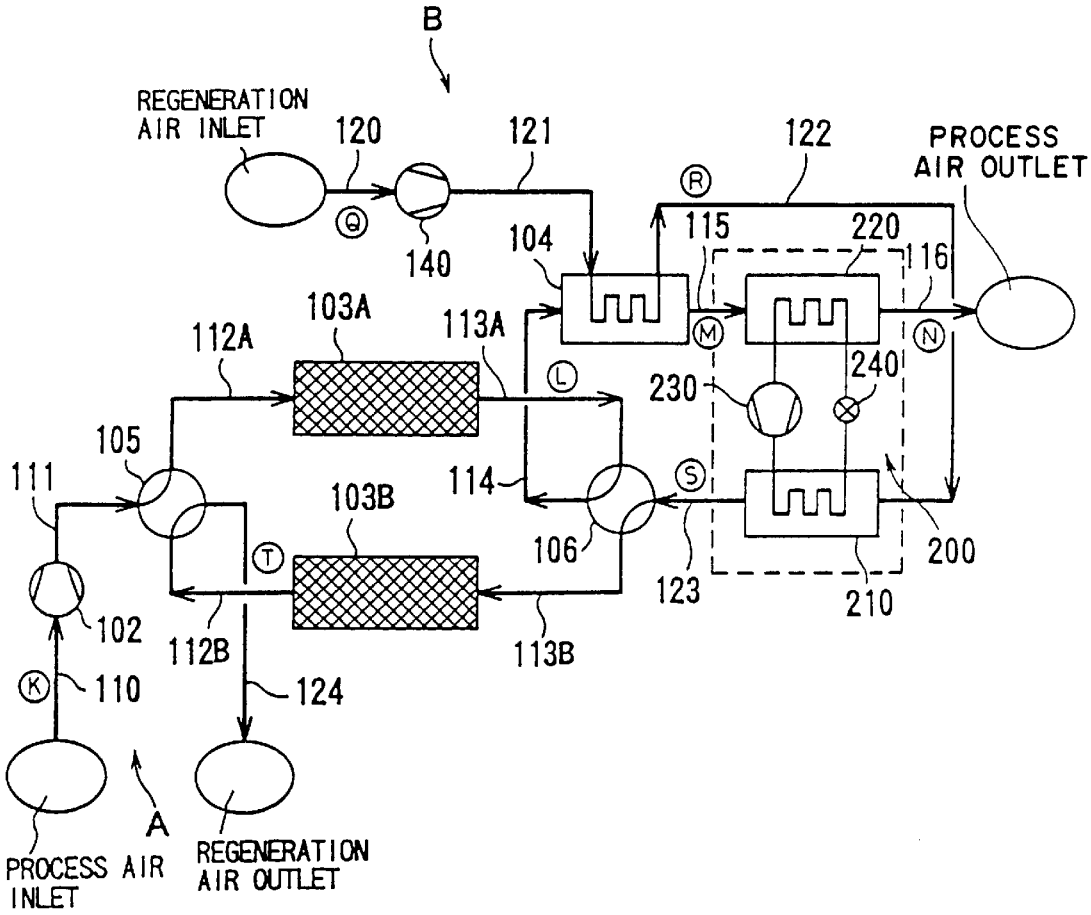
FIG. 1 is a schematic representation of a first embodiment of the basic configuration of the air conditioning system of the present invention.
Figure 2:
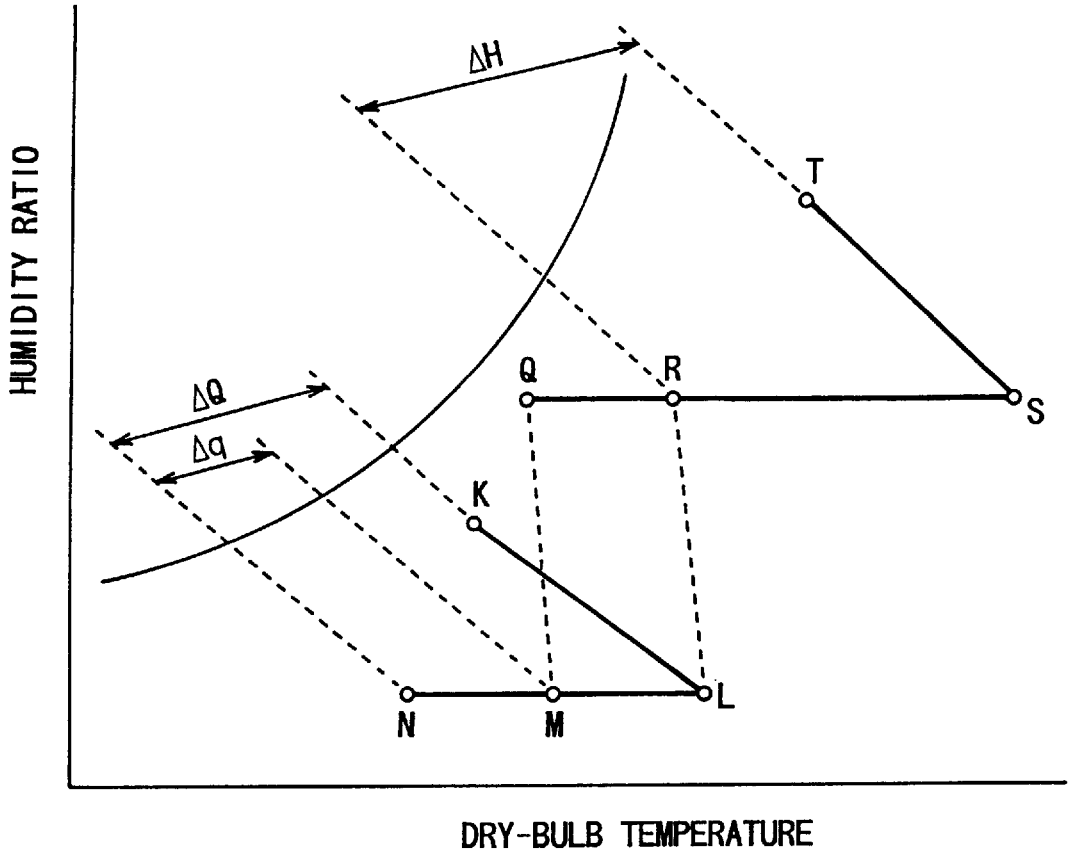
FIG. 2 is a psychrometric chart of the air conditioning cycle in the first embodiment.

FIGS. 1 and 2 relate to the first embodiment of the air conditioning system, which comprises: a process air passage A; a regeneration air passage B: two desiccant beds 103A, 103B; and a heat pump device 200 for performing regeneration of the desiccant and cooling for the process air. Any type of heat pump device can be used, but in this case, a vapor compressor type heat pump device disclosed in a U.S. patent application Ser. No. 08/781,038 filed by the inventors is used.

Process air passage A starts from a process air inlet (usually an interior air intake), and reaches the four-way valve 105 through the blower 102 and passage 111, and further reaches the four-way valve 106 by way of either: a first passage through the passage 112A, desiccant 103A, passage 113A; or a second passage through the passage 112B, desiccant 103B and the passage 113B, depending on the routing chosen by the four-way valve 105. The process air further progresses through the passage 114, a sensible heat exchanger 104 for providing heat exchange with regeneration air, and a heat exchanger 220 serving as the low temperature heat source for the heat pump device 200 to reach the process air outlet.

Regeneration air passage B starts from a regeneration air inlet (usually an exterior air inlet), and, through the passage 120, the blower 140, the passage 121, a heat exchanger 104 heat exchangeable with the process air, a heat exchanger 210 serving as the high temperature heat source for the heat pump device 200 and the passage 123, reaches the four-way valve 106. Regeneration air passage B ultimately reaches the four-way valve 105, by way of either: a first passage through the passage 113A, desiccant 103A, passage 112A; or a second passage through the passage 113B, desiccant 103B and the passage 112B, depending on the routing chosen by the four-way valve 106. The regeneration air further progresses through the passage 124 to the regeneration air outlet. Because the four-way valves 105, 106 are switched in a interlocking manner, the process air passage A and the regeneration air passage B do not cross one another.

Next, the operation of the first embodiment system having the heat pump device serving as the heat source, will be described with reference to a psychrometric chart shown in FIG. 2. The operation is according to the system setup shown in FIG. 1 which shows the four-way valves 105, 106 are positioned so that the desiccant 103A operates in the process air passage and the desiccant 103B operates in the regeneration air passage.

Process air (state K) is admitted into a process air inlet, and is withdrawn into the blower 102 through the passage 110, raised in pressure, and is forwarded, through the passages 111, the four-way valve 105, and the passage 112A, to one desiccant bed 103A where the moisture in the air is adsorbed to lower its humidity ratio, and the temperature is raised by the heat of adsorption (state L). The air which has been dehumidified and raised in temperature is supplied to the sensible heat exchanger 104 through the four-way valve 106, passage 114, and is cooled in the sensible heat exchanger 104 by heat exchange with the regeneration air (state M). The air which has been dehumidified and cooled is forwarded to the heat exchanger 220 serving as the low temperature heat source for the heat pump device 200, and after being cooled, it is finally supplied to the conditioning space through the passage 116 (state N). An enthaly difference DQ thus produced between the processed air (state K) and the supply air (state N) provides cooling to the conditioning space.

During the same cycle, the other desiccant 103B performs a regeneration process as follows. Regeneration air (state Q) is withdrawn into the blower 140 through the passage 120, raised in pressure, and is forwarded to the sensible heat exchanger 104 through the passages 121, and cools the process air while its own temperature is being raised (state R). The regeneration air then flows into the heat exchanger 210 acting as the high temperature heat source of the heat pump device 200 through the passage 122, and is heated by the the refrigerant to about 60~80 ° C., and its relative humidity is lowered (state S). The regeneration air having a lowered relative humidity passes through the desiccant bed 103B to remove the moisture in the desiccant bed (state T). The regeneration air which has passed through the desiccant bed 103B reaches the regeneration air outlet through the passage 112B, four-way valve 105 and the passage 124.

As described above, the system is operated by repeating the process of alternating cycles of dehumidification and cooling of each desiccant bed 103A, 103B. Incidentally, it has long been a wide practice to recycle the return room air as regeneration air, and in this invention, this approach may also be used to achieve the same end results.

In the present air conditioning system, the cooling effect produced by the heat pump device is represented by Dq, a differential enthalpy between the state M and state N shown in FIG. 2, which is significantly less than the cooling capacity for the entire system, DQ. In other words, the system can generate a cooling effect which surpasses the capacity of the heat pump device, thus enabling to produce a compact unit and lower the manufacturing cost.

Figure 3:
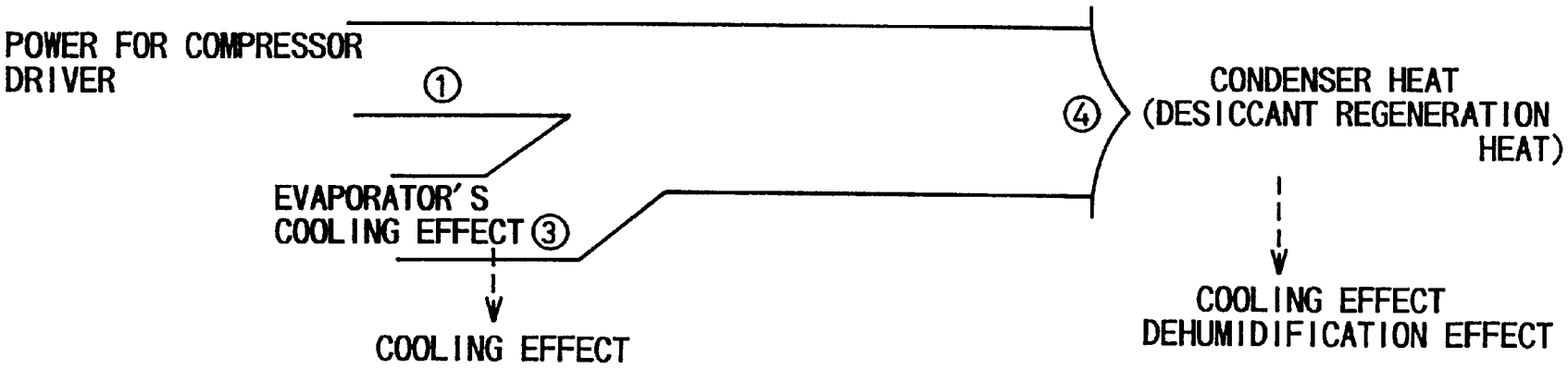
FIG. 3 is an illustration of the movement of heat in the present air conditioning system.

The thermal flow in the heat pump device of the present system is illustrated in FIG. 3. The heat input, represented by a sum of the heat released from the evaporator and that generated from the compressor, is given to heat the regeneration air. The temperature lift of this type of heat pump device can be estimated to be at least 55° C., in extracting heat from evaporator at 15° C. and raising it to 70° C., which is 22% higher than a typically achievable temperature lift of 45° C. in conventional heat pump devices, and the pressure ratio is also somewhat higher than the conventional heat pump devices. Therefore, when designating the heat output from the compressor as one heat unit, the coefficient of performance (COP) can be designed up to a value of 3 units. It follows that the input heat from the evaporator is 3, and the output heat is a total of 1+3=4, and all of this heat output is available to heat the regeneration air for use in the desiccant assisted air conditioning system.

Figure 7:
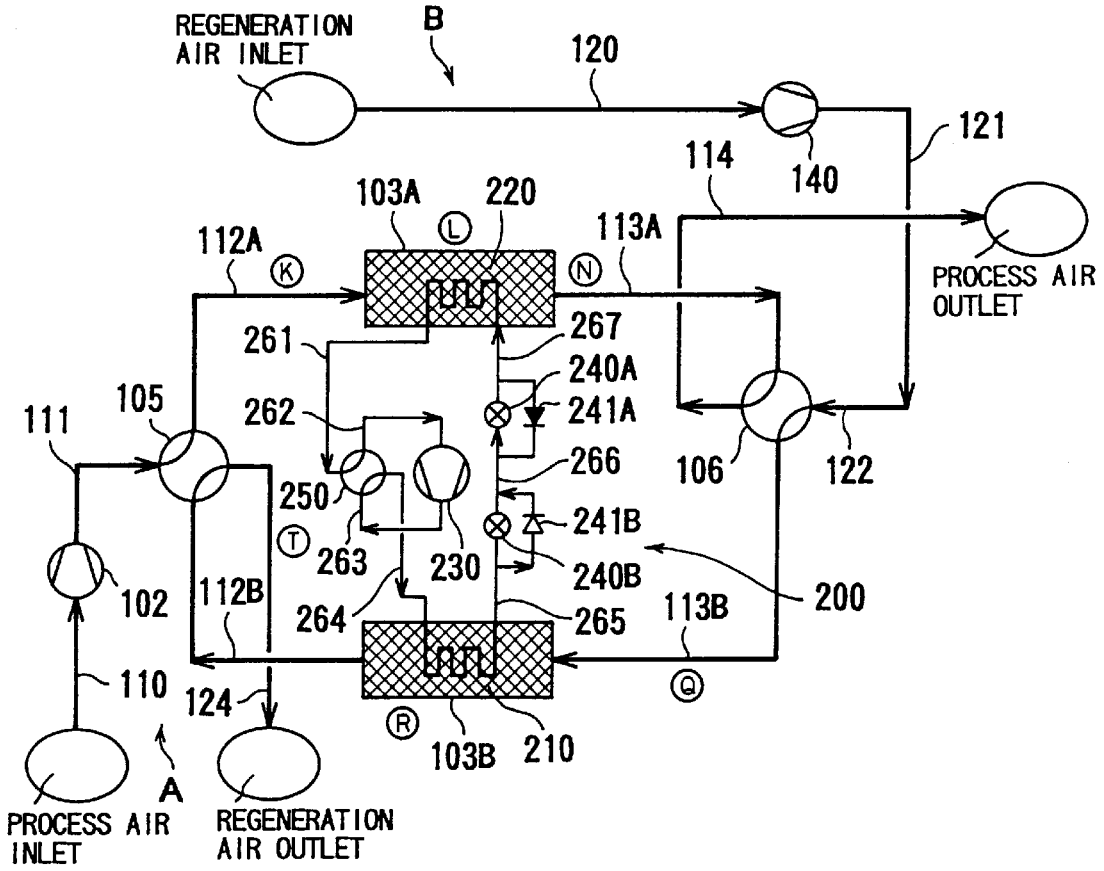
FIG. 7 is a schematic representation of a conventional air conditioning system.
Figure 8:
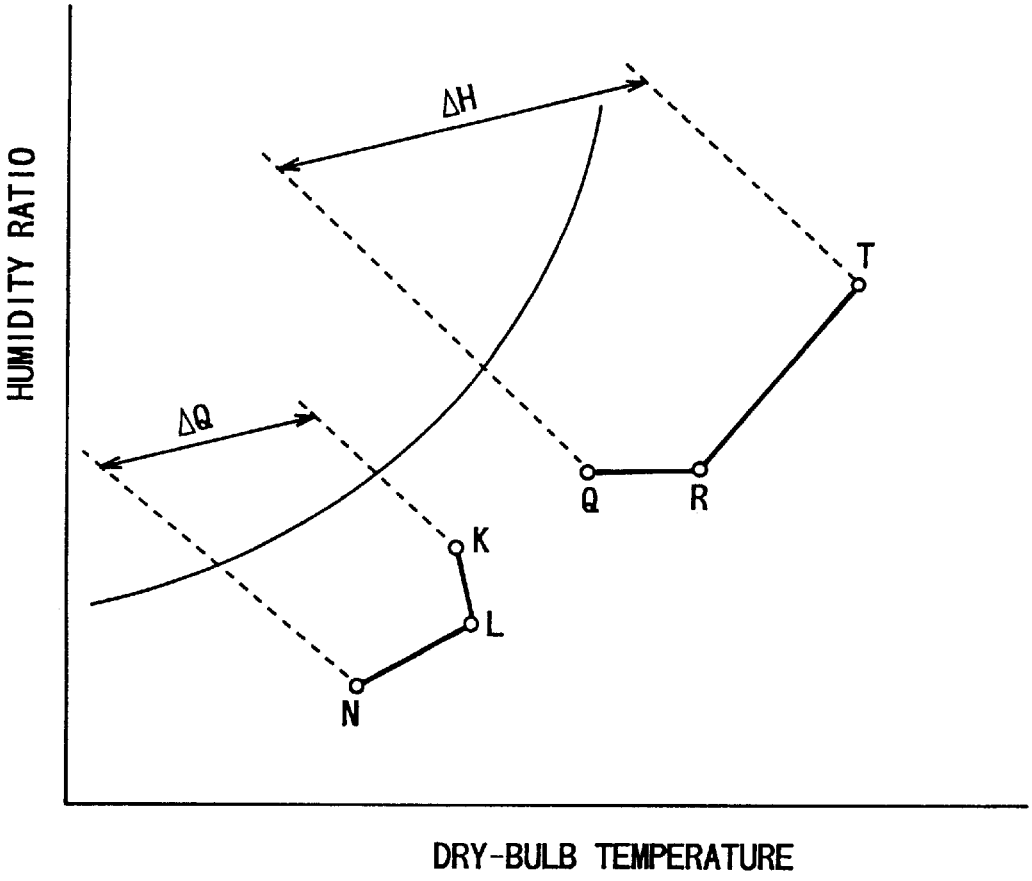
FIG. 8 is a psychrometric chart of the air conditioning cycle in the conventional air conditioning system.

The value of COP to show the energy efficiency per one unit of the present system is given by dividing the cooling effect DQ shown in FIG. 2 by the input regeneration heat DH. In the conventional technology shown in FIG. 7, the cooling effect is obtained only from the heat pump action (Dq in FIG. 2) while in the present system, there is a contribution (DQ−Dq) from the sensible heat exchanger 104 operating between the process air and the regeneration air. The numerator is increased by this amount and a higher value of energy efficiency is thus achieved.

The value of COP (DQ/DH) of desiccant assited cooling system is generally reported in a range of 0.8~1.2 at best. Assuming a value of 1 for COP of the desiccant assisted cooling system, the cooling effect of the air conditioning system is 1. Assuming a value of 1 for the heat input from the compressor, the total available thermal input for operating the present system is 4 which means that the cooling effect of 4 is obtainable from the heating of the regeneration air. In the present system, there is an additional cooling effect of 3 contributed by the evaporator, thus providing a total of 7 for the cooling effect of the present system. The overall system COP is given by:

$$COP=\text{cooling effect/compressor input}=7$$

and it can be seen that this value is significantly higher than a value of "4 or less" typical of the conventional system.

Figure 4:
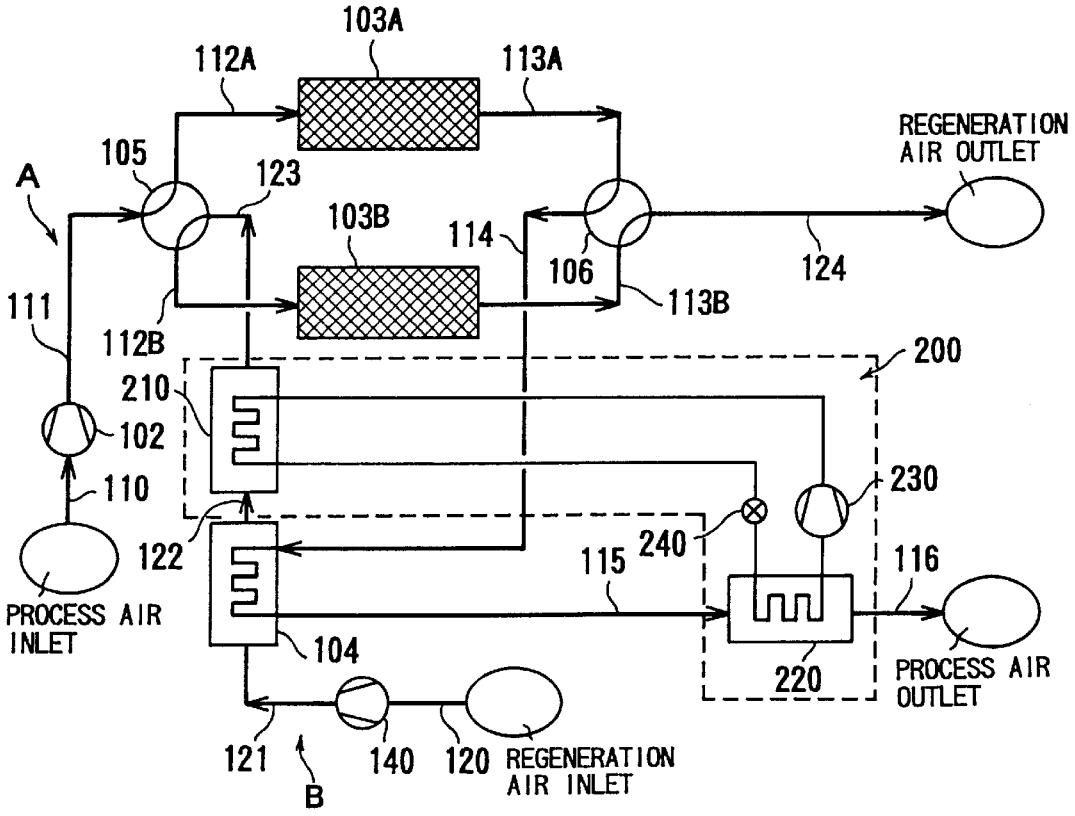
FIG. 4 is a schematic representation of a second embodiment of the basic configuration of the air conditioning system of the present invention.

FIG. 4 shows a second embodiment of the present system in which the process air and the regeneration air in the desiccant bed 103 are circulated in the same direction. The operational diagram of this embodiment is essentially the same as that shown in FIG. 2, and it will not be repeated.

Figure 5:
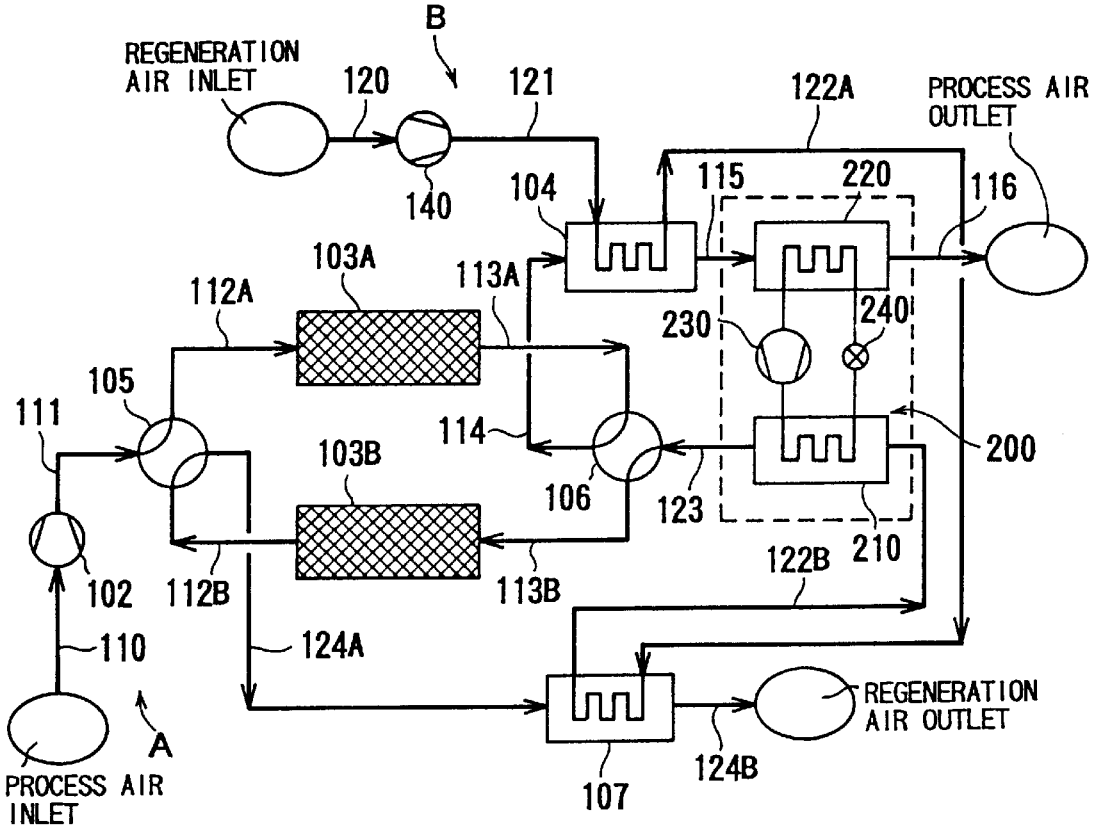
FIG. 5 is a schematic representation of a third embodiment of the basic configuration of the air conditioning system of the present invention.

FIG. 5 shows a third embodiment of the present system. An additional heat exchanger 107 has been added to the system shown in FIG. 1, for heat transfer between the regeneration air after it has passed through the desiccant 103B and the regeneration air before it enters into the high temperature heat source 210 of the heat pump device 200.

Figure 6:
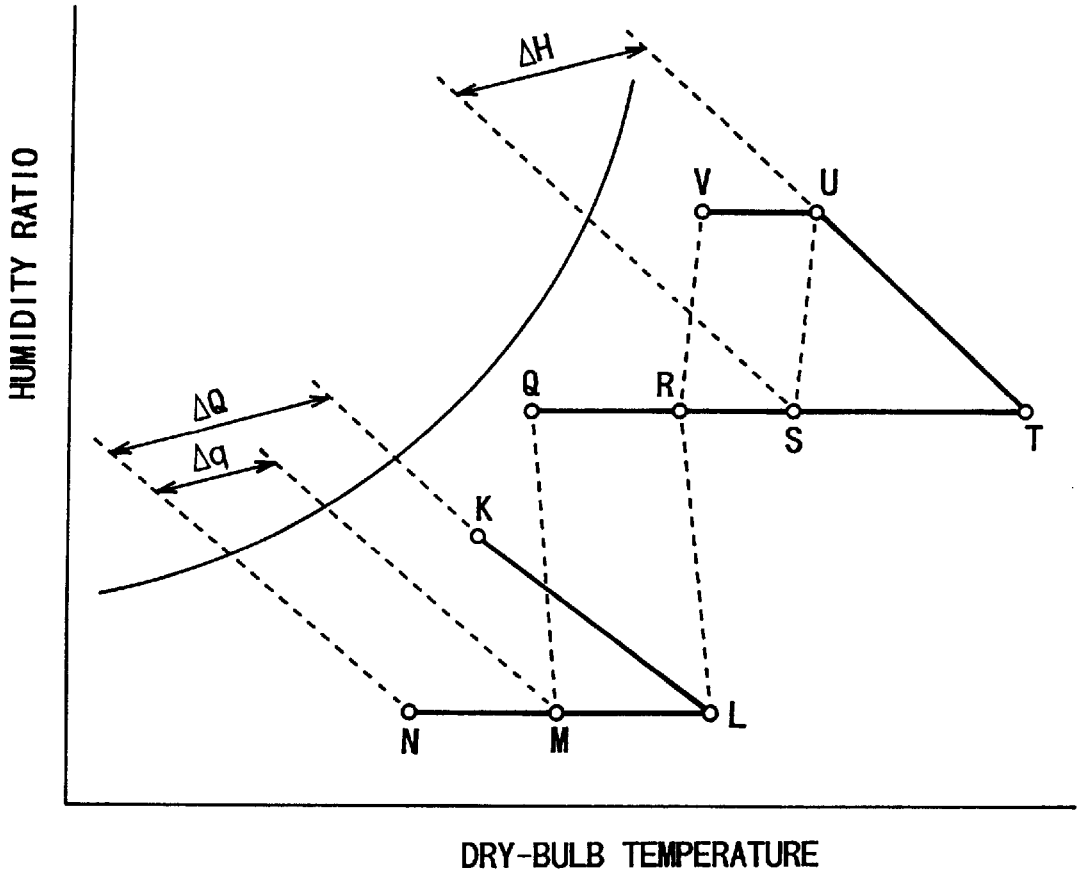
FIG. 6 is a psychrometric chart of the air conditioning cycle in the third embodiment.

The regeneration action of the third system will be described with reference to the psychrometric chart shown in FIG. 6. Regeneration air (state Q) is withdrawn into the blower 140 through the passage 120, raised in pressure, and is forwarded to the sensible heat exchanger 104 through the passage 121, and cools the process air while its own temperature is being raised (state R). The regeneration air then flows into the heat exchanger 107 through the passage 122A, and is heated further by heat exchange with the regeneration air which has passed through the desiccant 103B (state S). This regeneration air enters into the high temperature heat source 210 of the heat pump device 200 through the passage 122B, and is heated by the refrigerant to about 60~80° C., and its relative humidity is lowered (state T). The regeneration air having a lowered relative humidity passes through the desiccant bed 103B to remove the moisture in the desiccant bed (state U). The regeneration air which has passed through the desiccant bed 103B flows into the heat exchanger 107 through the passage 112B, the four-way valve 105 and the passage 124A, and transfers heat to the regeneration air before it enters into the high temperature heat source 210 of the heat pump device 200 to raise its temperature. The spent regeneration air which has released its heat and has become cooler (state V) is discharged to outside environment. Because the sensible heat of the spent regeneration air after regenerating the desiccant is effectively utilized, this embodiment system produces higher thermal efficiencies than the first embodiment system.

In the above embodiments, a vapor compressor type heat pump device was used for the heat pump device 200, however, any type of heat source can be used so long as it provides a heat pump action. For example, an absorption type heat pump disclosed in U.S. patent application Ser. No. 08/769,253 can be used to produce the same benefits.

Summarizing the significant features of the present desiccant assisted air conditioning system, switchable dual passages are provided to alternately treat the process air and regeneration air through a pair of desiccant members so that moisture in the process air is adsorbed in the one passage while the regeneration air is regenerating the desiccant in the other passage. The high temperature heat source of the heat pump device is placed in the regeneration air passage to heat the regeneration air while the low temperature heat source is placed in the process air passage to cool the process air. This arrangement enables to utilize the heat pump device to not only act as a heat source for desiccant regeneration but also to utilize the sensible heat exchanger between the process air and regeneration air to enhance thermal efficiency. The combined effect of this arrangement enables to produce cooling effect in excess of the cooling capacity of the heat pump device, and to achieve a significantly higher energy efficiency for operating the air conditioning system.

What is claimed is:

1. A desiccant assisted air conditioning system comprising: a process air passage for dehumidification of process air and a regeneration air passage for regeneration of a desiccant material; at least two desiccant members, one desiccant member being disposed in said process air passage and other desiccant member being disposed in said regeneration air passage; a sensible heat exchanger; and a heat pump device, wherein a high temperature heat source of said heat pump device is disposed in said regeneration air passage for heating regeneration air, a low temperature heat source is disposed in said process air passage for cooling of process air, and said sensible heat exchanger exchanges heat between process air which has passed through said one desiccant member and regeneration air which has not yet entered into said other desiccant member.

2. A desiccant assisted air conditioning system according to claim 1, wherein an additional sensible heat exchanger is provided for transferring heat between regeneration air which has passed through said other desiccant member and regeneration air which has not yet entered into said high temperature heat source.

3. An air conditioning system according to claim 1, wherein said heat pump is a vapor compression heat pump.

4. An air conditioning system according to claim 1, wherein said heat pump is an absorption heat pump.

5. An air conditioning system according to claim 1, further comprising a switching valve for alternatingly switching said desiccant member from one of said regeneration air passage and said process air passage to another.

6. An air conditioning system according to claim 1, wherein said regeneration air passage and said process air passage are arranged in a manner that regeneration air and process air flow in reverse directions to each other in said desiccant member.

* * * * *